United States Patent [19]

Boutillette

[11] 4,056,114

[45] Nov. 1, 1977

[54] PARTS WASHER AND FILTER ASSEMBLY THEREFOR

[76] Inventor: Arthur A. Boutillette, 22 Old Dudley Road, Oxford, Mass. 01540

[21] Appl. No.: 583,452

[22] Filed: June 3, 1975

[51] Int. Cl.[2] ..... B08B 3/02

[52] U.S. Cl. ..... 134/104; 134/111; 134/200; 210/167; 210/315

[58] Field of Search ..... 134/92, 94, 102, 103, 134/104, 111, 135, 191, 200-201, 110, 10; 210/167, 315, 416, 338

[56] References Cited

U.S. PATENT DOCUMENTS

| | | | |
|---|---|---|---|
| 1,048,862 | 12/1912 | Nesbitt | 134/135 |
| 1,658,413 | 2/1928 | Patelski | 134/191 X |
| 1,771,436 | 7/1930 | Guett | 134/102 |
| 1,813,226 | 7/1931 | Birdsall | 210/338 X |
| 2,295,982 | 9/1942 | Widman | 210/416 R X |
| 2,314,048 | 3/1943 | Ladewig | 134/104 |
| 2,352,356 | 6/1944 | Albertson | 134/111 |
| 2,440,619 | 4/1948 | St. Laurence | 134/200 X |
| 2,559,472 | 7/1951 | Shanaman | 134/94 |
| 2,595,838 | 5/1952 | Fuglie | 210/167 X |
| 2,675,012 | 4/1954 | Scales | 134/111 X |
| 3,343,555 | 9/1967 | Kasner | 134/111 |
| 3,378,019 | 4/1968 | Riolo et al. | 134/111 |
| 3,890,988 | 6/1975 | Lee | 134/111 |

*Primary Examiner*—Robert L. Bleutge

*Attorney, Agent, or Firm*—Strauch, Nolan, Neale, Nies & Kurz

[57] ABSTRACT

A solvent recirculating and cleaning parts washer having a sink mounted on top of a tank. Contaminated solvent is drained from the sink into one side of the tank and recirculated to the sink by a pump on the opposite side of the tank, heavier contaminants falling to the bottom of the tank away from the pump to avoid clogging of the pump. A multi-partition filter assembly surrounds the pump. The sink includes an overflow pipe, an aeration system for agitating the parts being cleaned, a removable parts basket which may be suspended from the side of the tank to dry and a safety cover which closes in the event of fire. A normally open valve having a fusible link operator shuts down the aeration system in the event of fire. The sink has a hand operated drain valve and a replaceable plastic liner is placed in the tank to contain solvent and water.

23 Claims, 10 Drawing Figures

FIG. 2
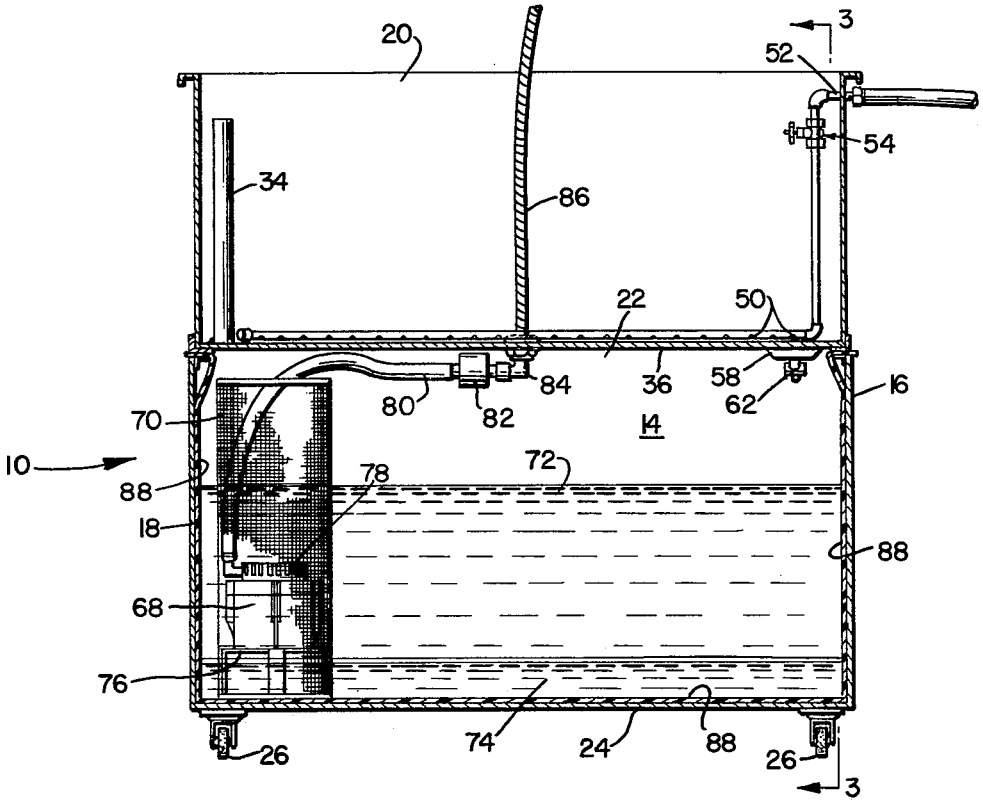
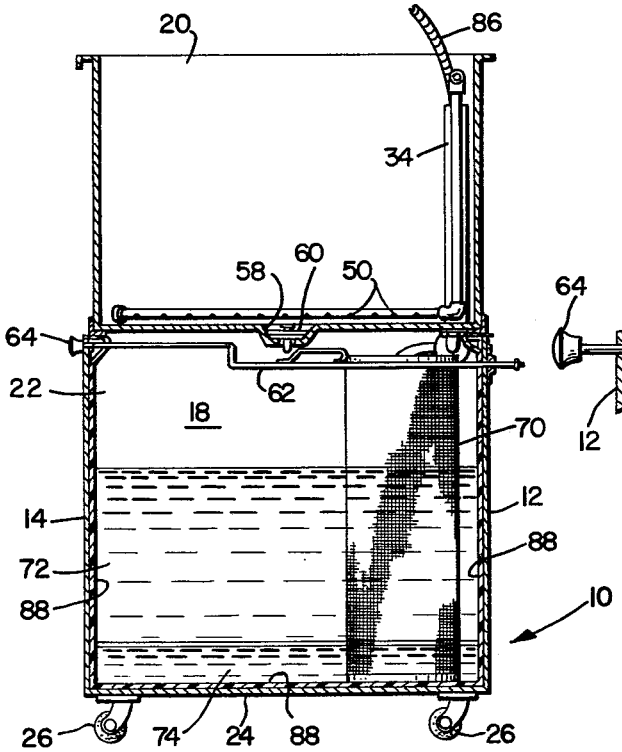
FIG. 3
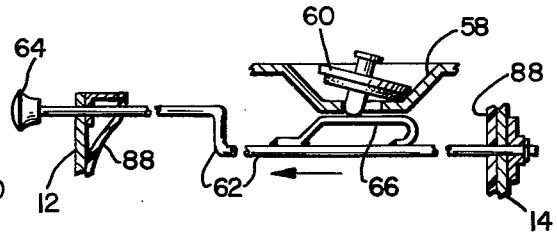
FIG. 7

PARTS WASHER AND FILTER ASSEMBLY THEREFOR

BACKGROUND OF THE INVENTION

Parts washers including solvent recirculating and cleaning systems are well known and widely accepted in industries ranging from typewriter repair to aircraft maintenance shops for cleaning and decontaminating dirty, greasy parts and tools. Such washers are rapidly replacing the inconvenient and unsafe gasoline filled bucket as a way of cleaning dirty parts and tools.

The patented art is replete with examples of parts washers. Most include a sink for washing the parts including a solvent supplying hose which is directed over the parts by the operator, a tank containing a solvent supply, a pump for recirculating solvent through the sink and some sort of filtration system for removing contaminants from the solvent before it is reused. To date, such filtration systems are deficient to a greater or lesser degree in that either the solvent must be replaced after being recirculated only a few times, thus resulting in unnecessary inconvenience and expense, or the filtration system, if efficient, is complex and is soon clogged with contaminants whereby the washer must be disassembled for cleaning the filters and then reassembled for use. Obviously, this time consuming procedure is equally unsatisfactory.

Eary examples of parts washers are evidenced in U.S. Pat. Nos. 2,653,617, 2,677,381; and 2,746,647. Some are expressly designed for service station use and thus include a compressed air connection for circulating the solvent or cleaning fluid, as disclosed in U.S. Pat. Nos. 2,897,830 and 3,352,310. In U.S. Pat. No. 3,020,918, liquid is circulated to agitate the parts as they are washed. The filtration problem has led to some exotic proposed solutions, such as a series of stacked sediment receiving and holding trays as in U.S. Pat. No. 2,675,012 and a divided tank arrangement with a primary sludge or sediment trap as disclosed in U.S. Pat. No. 3,343,555.

Other patents disclosing parts washers include U.S. Pat. Nos. 3,016,841; 3,378,019 and 3,416,544. This listing is by no means exhaustive of the patented art but merely exemplary.

Parts washers which have enjoyed commercial success include a parts washer manufactured by the Safety-Kleen Corporation of Elgin, Illinois which is disclosed in U.S. Pat. No. 3,522,814. A removable plastic liner or bag is provided for easily discarding accumulated contaminants and dirty solvent and the sink cover has a fusible link which melts in the case of fire to reduce the danger of further fire or an explosion by closing the cover. Another parts washer is manufactured by Solv-X, Inc. of Ontario, Canada. This device also has a removable plastic bag; a water layer at the bottom of the tank collects heavier debris while denser oils and greases collect at the top of the water layer beneath the solvent. A conical filter is arranged over a recirculating pump beneath the sink drain, in the tank. Aesthetics has a role in parts washers; Solv-X, Inc. is the assignee of U.S. Pat. No. D232,322.

Remote environment filter assemblies having spaced, concentric layers are disclosed in prior U.S. Pat. Nos. 410,767; 2,314,048; and 3,349,919.

The instant invention overcomes the disadvantages of prior art parts washers such as discussed above by providing a tank arrangement and filter assembly allowing for prolonged recirculation of solvent without need of frequently changing the solvent together with an efficient but simplified filtration system wherein components are easily and efficiently cleaned.

SUMMARY OF THE INVENTION

Therefore, it is a principal object of the invention to provide a parts washer with a solvent recirculation and cleaning system including a tank and recirculating pump having a multi-partition filter assembly surrounding the pump for efficiently removing contaminants from the solvent.

It is another object of the invention to provide a parts washer having a recirculating, filtered pump and supply tank wherein the tank contaminant solvent inlet and filtered pump are widely spaced apart in a lateral sense to allow a substantial percentage of contaminants to fall by gravity to a collection zone at the bottom of the tank before the solvent reaches the filter and pump.

It is a further object of the invention to provide a parts washer having a solvent recirculation and filtration system including a multi-layered filter having spaced concentric screens of similar mesh to primarily retard solvent flow therethrough so that contaminants may fall to a bottom collection zone rather than be trapped in the layers of the screen.

It is yet another object of the invention to provide a filter assembly for the pump of the recirculation system of a parts washer being made of several concentrically arranged spaced screens of similar mesh and an interior, fine mesh final filter surrounding the pump for final polishing of the solvent just prior to recirculation.

It is yet a further object of the invention to provide a filter assembly for the pump of the recirculation system of a parts washer including a plurality of concentrically arranged screens surrounding the pump together with a final in-line filter interposed in the outlet conduit of the pump.

Still another object of the invention is to provide a parts washer having a solvent recirculation and filtration system which is portable, low in cost of manufacture and operation, and is equipped with safety features to reduce the dangers of fire.

Further novel features and other objects of this invention will become apparent from the following detailed description, discussion and the appended claims taken in conjunction with the accompanying drawings.

BRIEF DESCRIPTION OF DRAWINGS

Preferred structural embodiments of this invention are disclosed in the accompanying drawings in which:

FIG. 2 is a front viewed vertical section view of the embodiment of the invention shown in FIG. 1;

FIG. 3 is a vertical section view taken along lines 3—3 of FIGS. 2;

FIG. 7 is a detail view depicting the sink drain of the parts washer;

DESCRIPTION OF THE PREFERRED EMBODIMENTS

Figure 1:
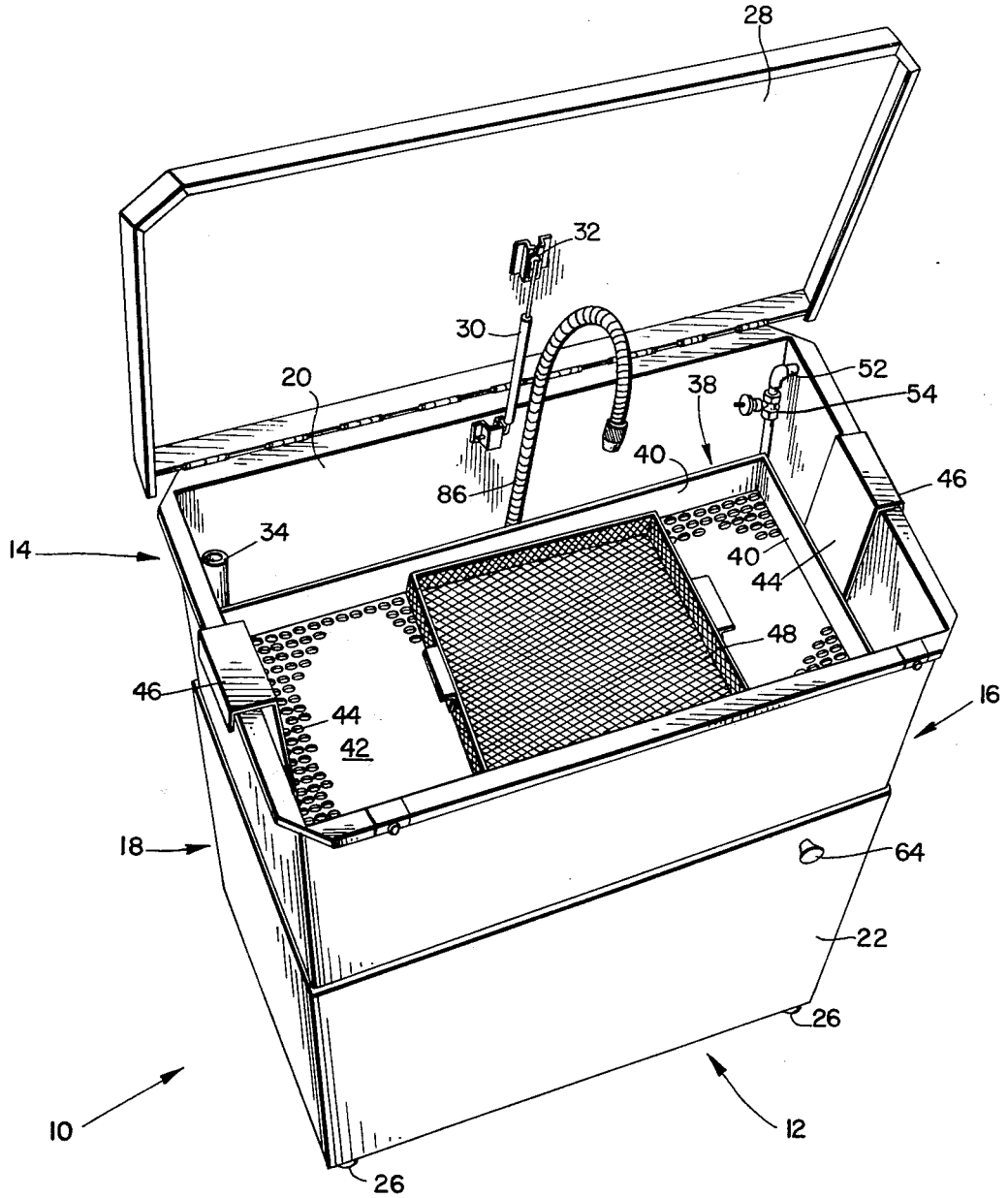
FIG. 1 is a perspective view of a primary embodiment of the invention.

A parts washer generally indicated at 10 includes an open topped cabinet structure having a front wall 12, rear wall 14 and side walls 16 and 18. A sink 20 for washing dirty parts and tools forms an upper part of the cabinet structure while a tank 22 having a bottom 24 forms the lower part of the cabinet structure as shown. Tank 22 may include caster wheels 26 at the four bottom corners to facilitate portability of parts washer 10. A safety cover 28 is hingedly secured to the top rear of sink 20 and is maintained in an open attitude by a strut 30 which may be spring loaded to soften a closing motion. Strut 30 is fusibly linked at 32 to cover 28 so that in the event of fire, the strut is released from cover 28 so that it closes, thus serving to smother any fire within sink 20 and reduce the chances of a dangerous explosion. In this respect, it will be noted that strut 30 links cover 28 and sink 20 together so that cover 28 may not be raised to a full vertical attitude. Rather, cover 28 when open will remain tilted forwardly over sink 20 so that it will fall and close sink 20 in the event of fire.

Within sink 20 is an overfill tube or drain 34 communicating through bottom 36 of sink 20 into tank 22. Should sink 20 be inadvertently filled with cleaning fluid or solvent above a predetermined level defined by the upper open end of overfill tube 34, such fluid will merely drain harmlessly back into tank 22 instead of spilling over the edges of sink 20 and onto the floor of a work area.

A parts basket 38 is provided to hold parts or tools as they are being washed. Basket 38 includes a peripheral flange 40 about the four sides thereof and a perforated bottom 42 for draining cleaning fluid to sink 20 therebeneath. Basket 38 includes a pair of handles 44 at either end thereof hingedly secured to bottom 42 at the junction of bottom 42 and flange 40. The free ends 46 of handles 44 are shaped to conform to and hook over the top side edges of sink 20 to securely suspend basket 38 within sink 20, above sink bottom 36. After use, basket 38 may be suspended by one handle 44 from an edge of the sink to facilitate drying of the basket.

If desired, a second parts basket 48 may be provided for the washing of small parts and/or tools.

Figure 9:
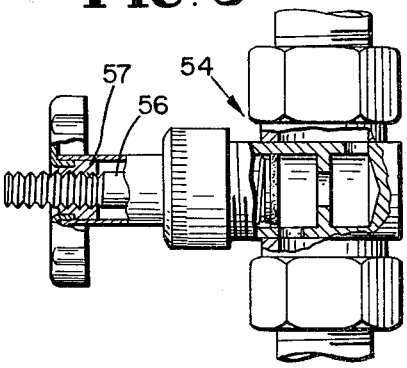
FIG. 9 is a detail view of the fusible link operated valve of the agitator air supply for the parts washer.
Figure 10:
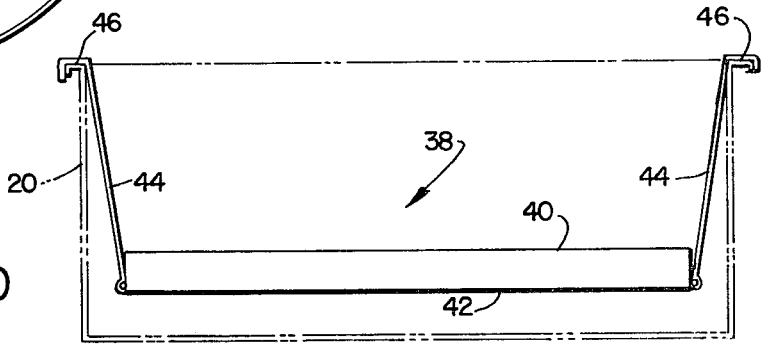
FIG. 10 is a detail view of the parts holding basket used in the parts washer.

A perforated tube 50 (see FIGS. 2 and 3) is located diagonally across sink bottom 36 and is connected via a fitting 52 through a side wall of sink 20 to a source of compressed gas (not shown). Normally, the source of gas is compressed air, due to the practical fact that such a gas source is normally available in places where this invention will be used (garages, service stations, machine shops, factories, etc.) A hand operable normally open valve 54 (see FIG. 9) is interposed at one end of fitting 52 and has a fusible link, spring loaded operator shaft 56. In the event of fire, the fusible link, which is lead sleeve 57, melts, and permits the spring loaded shaft 56 to close valve 54, thus terminating any further supply of air to sink 20 which would, of course, only oxygenate any fire and make conditions more hazardous.

The purpose of perforated tube 50 is to agitate the cleaning fluid or solvent in sink 20 during a parts washing operation so that dirty parts or tools may be washed and scrubbed without need of an operator. This frees the operator to do more important work while the tools or parts are being cleaned.

A drain 58 is located in sink bottom 36 at one side of sink 20, adjacent the junction of front wall 12 and side wall 16, for reasons to be explained in detail hereinbelow. Drain 58 includes a captive, vertically movable plug or stopper 60. A drain opening and closing assembly 62, operable from the exterior of parts washer 10 by handle 64 is provided so that an operator does not have to contact cleaning fluid or solvent in sink 20 in order to operate the drain. Operator 62 includes an intermediate bridge 66 which operates as a cam to lift plug 60 to allow contents in sink 20 to drain through drain 58 to tank 22 when handle 64 is pulled to the left, in the sense of FIG. 7. When handle 64 is pushed in, bridge 66 moves to the right in the sense of FIG. 7 to allow stopper 60 to fall to a drain 58 closing position.

Referring now to FIGS. 2 and 3 in particular, the cleaning fluid or solvent recirculation system will be explained. A submerged pump 68 is enclosed within and surrounded by a filtration screen system which in this embodiment of the invention is a single cylindrical screen 70. Screen 70 is of sufficient material thickness to be free standing, as shown in FIGS. 2 and 3, seated on tank bottom 24 and extending well above a predetermined level of solvent 72. The cleaning fluid or solvent 72 may be of any acceptable composition, preferably being mineral cleaning spirits. Beneath solvent 72 is a layer of water 74 which serves to collect contaminants falling thereto under the influence of gravity. Less dense contaminants will collect at the interface of solvent 72 and water 74. Preferably, the layer of water is about 2 inches deep and the layer of solvent is approximately 14 inches deep.

Pump 68 is mounted on top of a shelf 76 located within screen 70, the inlet 78 of pump 68 being located well above the water layer as shown in FIGS. 2 and 3 so that only clean solvent is pumped from pump 68 to an outlet conduit 80, a final polishing filter 82, a connection 84 through sink bottom 36 and to flexible hose 86 which may be manually directed over parts being washed while the pump is operating. Contaminated solvent is then drained at 58 back into tank 22.

Another method of operation which does not require the presence of an operator involves filling of sink 20 via pump 68, drain 58 being closed by stopper 60, the parts or tools to be cleaned having been previously placed within basket 38 or 48, located in sink 20 (FIG. 1). Thereafter, valve 54 is opened to allow air to bubble through perforated pipe 50, thereby agitating the solvent and assisting in cleaning the parts. During this time, the operator may attend to other duties. When the operation is completed, the operator shuts valve 54, opens drain 58 by pulling handle 64 (FIG. 7) and then removes the cleaned parts. It should be noted here that at no time does the operator need to contact the solvent with his hands, thus eliminating any chance of the operator suffering injury from the burning action of solvent on his skin.

As can be seen in FIGS. 2 and 3, tank 22 includes a removable and replaceable liner 88 which contains the water 74 and solent 72. Whenever water 74 becomes so full of debris that it ought to be changed, solvent 72 is first pumped from tank 22 into a standby container (not shown). The remaining water and debris enclosed in the liner is merely lifted out with the liner and discarded. Thereafter, a fresh liner 88 is installed in tank 22 and filter screen 70 with pump 68 are replaced. Fresh water is placed in tank 22. Finally, the pumped out solvent is pumped back into tank 22 (not shown). Alternatively, a fresh supply of solvent may be added.

As can be seen best in FIG. 2, drain 58 is located to one side of parts washer 10 and filtration screen 70 with pump 68 is located far to the other side of parts washer 10. The reason for such arrangement is that contaminated solvent entering tank 22 from sink drain 58 will have to travel a maximum distance, across the width of tank 22 prior to entering screen 70 to be pumped back to sink 20 by pump 68. During the travel of solvent thru such maximum distance, most of the contaminants will have a chance to fall under the influence of gravity to water 74 and be collected therein before reaching screen 70, which then removes the small percentage of remaining contaminants. It has been found that this arrangement very effectively cleans solvent 72, greatly prolongs the useful life of pump 68 and furthermore necessitates a change of solvent only about once every year in normal use or once every 6 to 8 months under heavy use. Such solvent life and infrequency of need to service the parts washer is unknown in the industry.

Figure 4:
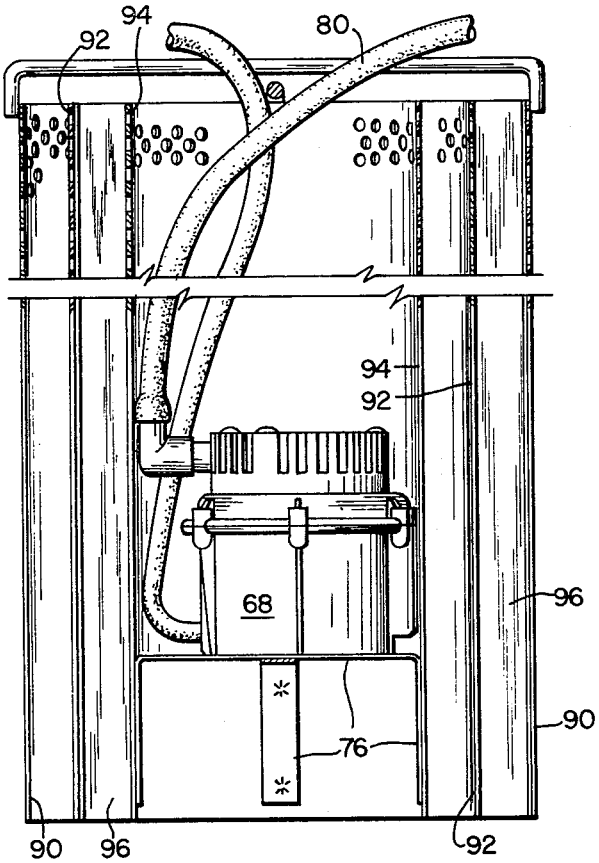
FIG. 4 is a vertical section view of one embodiment of the filter assembly with the pump in place.
Figure 5:
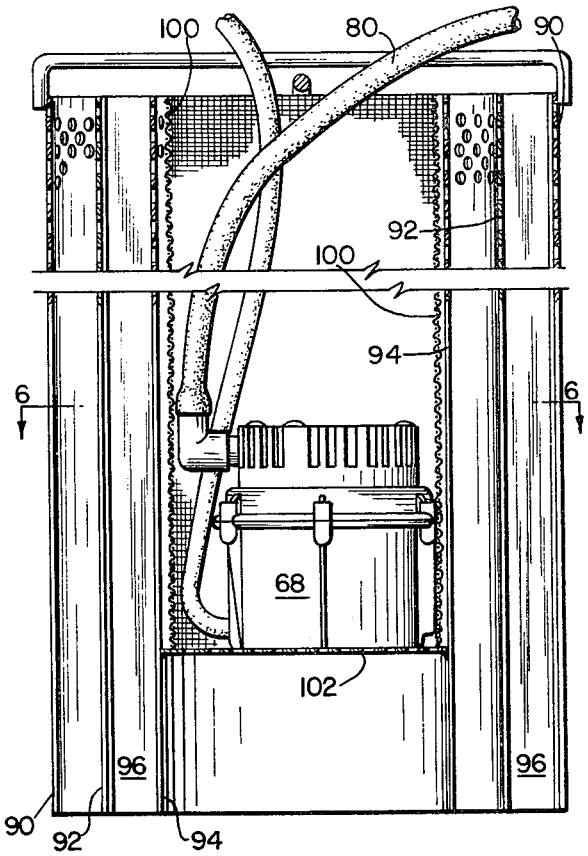
FIG. 5 is a view similar to FIG. 4 showing another filter assembly.
Figure 6:
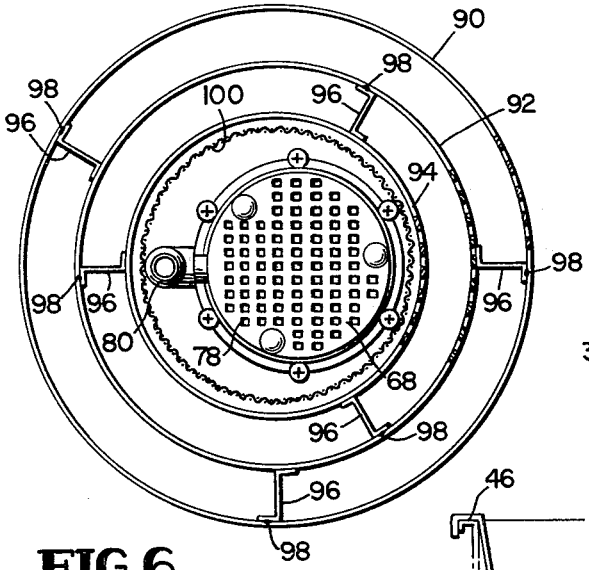
FIG. 6 is a section view taken along lines 6—6 of FIG. 5.
Figure 8:
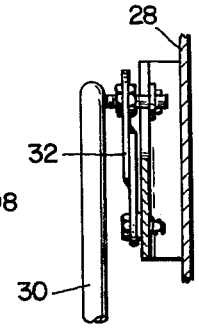
FIG. 8 is a detail view of the fusible link on the cover of the parts washer.

Several embodiments of the filtration system of the invention are shown in FIGS. 4–6 inclusive. In FIG. 4, the filtration system surrounding pump 68 includes a series of three concentrically arranged cylindrical screens 90, 92 and 94, spaced apart as by Z-stringers 96 spot welded to the screens at 98. Screens 90, 92 and 94 are telescopically fitted together, the innermost screen 94 including shelf 76 for pump 68. In a preferred embodiment, each screen 90, 92 and 94 is made of sheet metal with 1/16 inch diameter apertures spaced on ¼ inch centers. The filtration system is open at the bottom.

Such an assembly of filters 90, 92 and 94, open at the bottom, has been proven to be very effective in use, in that solvent passing through the screens to pump 68 is progressively slowed in travel velocity so that even minute contaminants will fall to water 74 therebeneath, the apertures in screens 90, 92 and 94 remaining quite clean of debris over a prolonged period of time. Thus, the system provides an effective filtration system employing a multi-stage filtration method while simultaneously minimizing the need for periodically cleaning the filters 90, 92 and 94.

In another embodiment of the invention, shown in FIGS. 5 and 6, the filtration system just described includes an additional or fourth filter screen 100, of substantially reduced mesh with respect to screens 90, 92 and 94, preferably about 200 mesh. This screen serves as a final "polisher" for the solvent just before it enters pump inlet 78. Of course, downstream filter 82 will even further polish the solvent passing therethrough. In this embodiment, pump 68 may be mounted on shelf 76 as shown in FIG. 4, or a cylindrical shelf plate 102 having evenly spaced ¼ inch apertures arranged on ½ inch centers may be provided.

The invention may be embodied in other specific forms without departing from the spirit or essential characteristics thereof. The present embodiments are therefore to be considered in all respects as illustrated and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A cleaning fluid recirculating and filtering parts washer comprising: a generally rectangular cabinet structure including front, rear and side walls and a bottom; a sink for washing parts forming an upper portion of said cabinet, a controllable drain in said sink located adjacent one of said cabinet walls; a tank forming a lower portion of said cabinet and communicating with said drain; pump means for circulating cleaning fluid to said sink located in said tank adjacent another of said cabinet walls opposite the disposition of said sink drain and said one cabinet wall; and cleaning fluid filtration means surrounding said pump means and extending from said cabinet bottom to a level above a predetermined level of cleaning fluid therein; whereby cleaning fluid contaminated by a parts washing operation in said sink and entering said tank from said sink drain must travel substantially across said tank, from said drain to said pump means, thus allowing a substantial portion of waste particles and other contaminants to settle by gravity to the bottom of said tank prior to passing through said filtration means and pump for circulation back to said sink.

2. The parts washer as claimed in claim 1 further comprising a hinged cover on the top of said cabinet and fusible link strut means for maintaining said cover in an open condition, said fusible link melting in the event of fire to release said lever and allow said cover to close under the influence of gravity.

3. The parts washer as claimed in claim 1 wherein said sink further comprises overfill tubular means communicating with said tank for draining cleaning fluid back to said tank in the event of filling of said sink above a predetermined level.

4. The parts washer as claimed in claim 1 wherein said sink further comprises a parts holding basket having a perforated bottom and handle means at opposite ends of said basket, for suspending said basket in said sink said handle means being hingedly secured to said perforated bottom whereby said basket may be suspended in a vertical attitude exteriorally on said cabinet after use for drying.

5. The parts washer as claimed in claim 1 wherein said sink further comprises perforated tube means substantially across the bottom of and in said sink and fluid communication means from said sink through a cabinet wall for connection to a source of compressed gas whereby during a parts washing operation, gas is bubbled through cleaning fluid in said sink from said perforated tube means to agitate the cleaning fluid and thereby assist the parts washing operation.

6. The parts washer as claimed in claim 1 wherein said cabinet further comprises drain closing and opening means operable on said drain from exterior of said cabinet.

7. The parts washer as claimed in claim 6 wherein said controllable drain and its opening and closing means comprise a vertically movable plug, handle means mounted through a wall of said cabinet and plug actuating means operatively connected to said handle means for raising and lowering said plug to thereby open and close said drain.

8. The parts washer as claimed in claim 1 wherein said tank further comprises removable and replaceable liner means locatable therewithin for facile disposal of accumulated, settled contaminants and replacement by clean, unused liner means.

9. The parts washer as claimed in claim 1 wherein said filtration means further comprise shelf means therein for mounting said pump means withing said filtration means at a predetermined level, above said tank bottom.

10. The parts washer as claimed in claim 1 wherein said pump means further comprise an outlet conduit and a hose connected to said outlet conduit and located over said sink for directing cleaning fluid over parts being washed in said sink.

11. The parts washer as claimed in claim 1 wherein a filter assembly is interposed between said conduit and hose.

12. The parts washer as claimed in claim 1 wherein said filtration means comprise at least one screen of predetermined mesh, said scren being generally cylindrical in configuration.

13. The parts washer as claimed in claim 12 wherein said filtration means comprise at least a pair of screens concentrically arranged about said pump means, said pair of screens being telescopically interfittable one within the other and spaced apart.

14. The parts washer as claimed in claim 13 wherein at least one of said screens comprise a perforated sheet metal cylindrical casing having a plurality of evenly spaced apertures therethrough.

15. The parts washer as claimed in claim 16, wherein said filtration means comprise at least three of said perforated sheet metal cylindrical casings, telescopically arranged relative to and spced from one another.

16. The parts washer as claimed in claim 15 wherein said filtration means further comprise a fourth generally cylindrical screen located interiorally of said three casings immediately adjacent said pump means, the apertures of said fourth screen being of substantially reduced diameter with respect to the apertures of any one of said three casings.

17. The parts washer as claimed in claim 15 wherein the diameters of the apertures and the spacing thereof in all of said three cylindrical casings are equal.

18. The parts washer as claimed in claim 12 wherein said filtration means comprise at least three screens of predetermined mesh, concentrically arranged with respect to each other and said pump means, said screens being spaced apart from and telescopically arranged relative to one another and thereby defining an open bottomed multi-stage filtration assembly.

19. A cleaning fluid recirculating and filtering parts washer including: a cabinet; a parts washing sink in an upper part of the cabinet; a tank in a lower part of the cabinet for containing a supply of fluid; and a pump having an inlet communicating with said tank and outlet means communicating with said sink for circulating fluid from the tank to the parts washing sink; cleaning fluid filtration means surrounding the pump and extending from a bottom of the tank to a level above a predetermined level of cleaning fluid in the tank comprising a plurality of concentrically arranged screening means spaced apart with respect to one another and defining an open bottom therewithin and therebetween whereby contaminated cleaning fluid flowing therethrough to said pump will be slowed in velocity whereupon contaminant particles settle under the influence of gravity to said filtration means open bottom, said concentrically arranged screening means including at least two generally cylindrical sheet metal screen casings of different sizes having apertures therethrough and spacers therebetween securing said casings in spaced apart substantial concentricity; and means within the interior of said sheet metal screen casings providing a support for said pump and mounting said pump substantially above the filtration means open bottom.

20. The parts washer as claimed in claim 19 wherein said screening means are at least three of said sheet metal casings.

21. The parts washer as claimed in claim 20 wherein each of said cylindrical sheet metal screen casings have apertures therethrough of equal diameter and of equal spacing.

22. The parts washer as claimed in claim 20 further comprising a fourth screening means of extremely fine mesh with respect to said three screening means and being positioned interiorally of the innermost of said three screening means, immediately adjacent the pump.

23. A cleaning fluid recirculating and filtering parts washer comprising: a generally rectangular cabinet structure including front, rear and side walls and a bottom; a sink for washing parts forming an upper portion of said cabinet, a drain in said sink located adjacent one of said cabinet walls; a tank forming a lower portion of said cabinet and communicating with said drain; pump means for circulating cleaning fluid to said sink located in said tank adjacent another of said cabinet walls opposite the disposition of said sink drain and said one cabinet wall; and cleaning fluid filtration means surrounding said pump means and extending from said cabinet bottom to a level above a predetermined level of cleaning fluid therein; whereby cleaning fluid contaminated by a parts washing operation in said sink and entering said tank from said sink drain must travel substantially across said tank, from said drain to said pump means, thus allowing a substantial portion of waste particles and other contaminants to settle by gravity to the bottom of said tank prior to passing through said filtration means and pump for circulation back to said sink; said washer further comprising perforated tube means substantially across the bottom of and in said sink; fluid communication means from said sink through a cabinet wall for connection to a source of compressed gas whereby during a parts washing operation, gas is bubbled through cleaning fluid in said sink from said perforated tube means to agitate the cleaning fluid and thereby assist the parts washing operation, said fluid communication means including a normally open valve having a fusible link operator for closing said valve and terminating the supply of gas to said perforated tube means in said sink in the event of fire.

* * * * *

UNITED STATES PATENT OFFICE

CERTIFICATE OF CORRECTION

Patent No. 4,056,114 Dated November 1, 1977

Inventor(s) Arthur A. Boutillette

It is certified that error appears in the above-identified patent and that said Letters Patent are hereby corrected as shown below:

Column 1, line 29, change "eary" to -- Early --.

Column 7, line 13, Claim 12, change "scren" to --screen--.

Column 7, line 24, claim 15, after "claim" delete "16" and insert --14--.

Column 7, line 27, claim 15, change "spced" to --spaced--.

Signed and Sealed this

*Twenty-eighth* Day of *February 1978*

[SEAL]

*Attest:*

RUTH C. MASON
*Attesting Officer*

LUTRELLE F. PARKER
*Acting Commissioner of Patents and Trademarks*